United States Patent [19]

Larsson

[11] Patent Number: 4,466,201

[45] Date of Patent: Aug. 21, 1984

[54] METHOD AND AN ARRANGEMENT FOR STORING ORGANIC FIBROUS MATERIAL IN A STACK

[76] Inventor: Carl R. Larsson, Yxefall, S-590 40 Kisa, Sweden

[21] Appl. No.: 227,079

[22] PCT Filed: May 15, 1979

[86] PCT No.: PCT/SE79/00107

§ 371 Date: Jan. 15, 1981

§ 102(e) Date: Dec. 29, 1980

[87] PCT Pub. No.: W080/02573

PCT Pub. Date: Nov. 27, 1980

[51] Int. Cl.[3] ..... F26B 5/00

[52] U.S. Cl. ..... 34/27; 34/34; 98/57; 236/49

[58] Field of Search ..... 34/225, 27, 34, 77, 34/219; 98/56, 57; 236/49; 126/400; 71/23, 24, 9, 10; 422/184; 47/1.1, 58, 1.4

[56] References Cited

U.S. PATENT DOCUMENTS

| | | | |
|---|---|---|---|
| 722,118 | 3/1903 | Liles | 98/56 |
| 1,833,397 | 11/1931 | Hagen | 34/225 |
| 1,987,903 | 1/1935 | Hoodry | 98/56 X |
| 2,044,370 | 6/1936 | Shodron | 34/225 X |
| 2,903,955 | 9/1959 | Werner, Jr. | 98/56 |
| 4,061,267 | 12/1977 | Lof | 126/400 X |
| 4,184,856 | 1/1980 | Thoren | 165/DIG. 12 |
| 4,238,890 | 12/1980 | Curtis et al. | 98/56 X |
| 4,270,612 | 6/1981 | Larsson | 169/45 |
| 4,288,241 | 9/1981 | Shelef | 71/9 |

*Primary Examiner*—William E. Tapolcai

*Attorney, Agent, or Firm*—Strimbeck, Davis & Soloway

[57] ABSTRACT

A method of and apparatus for drying stored fibrous materials is disclosed. Dry air is injected into a stack of fibrous materials via delivery tube means, and air is withdrawn from the stack via suction tube means. The air withdrawn is then treated so as to remove moisture and cool the air. The cool dried air is then returned to the stack.

8 Claims, 5 Drawing Figures

METHOD AND AN ARRANGEMENT FOR STORING ORGANIC FIBROUS MATERIAL IN A STACK

The present invention relates to a method of storing organic fibrous material in a stack, barn or the like. The invention also relates to an arrangement for carrying out this method, comprising a pipe which is perforated over at least part of its length and is connected via valves to the pressure side of a fan for blowing air into the stack, and a control unit which actuates the valves, connected to a temperature indicator for monitoring the temperature of the material in the stack, this unit being designed to control the blowing in of air into the stack so that the temperature of the material lies within a predetermined temperature range.

During recent years considerable progress has been made in the field of tree and timber handling. To ensure the best use is made of the raw fibrous material, methods and machines for tree-felling, transportation and handling of whole tree trunks, branches and boughs, together with the excavation of the root systems, have been proposed. It has thus been possible to achieve a high level of exploitation of the raw timber in sawmills and pulp factories.

As for the question of exploiting the fibrous waste from tree-felling to produce energy, development has not advanced so far. Research has shown that only 8% of Swedish timber terrain is of such a nature that it is necessary to leave the timber waste behind. Since leaving behind timber waste such as stumps, branches and twigs results in an increased risk of damaging insects, it is important to remove waste timber. It can be shown that the energy content of timber waste is so high that with rationalised transportation and storage methods profitable exploitation of the timber waste can be achieved.

The aim of the present invention is to provide a method and an arrangement for storing fibrous material in a stack, this storage being effected in such a way that the heat content of the material is increased as the thermal energy released during storage is used, and this is made possible due to the fact that the storage is carried out as revealed in the characteristics in the attached Patent Claims.

Figure 1:
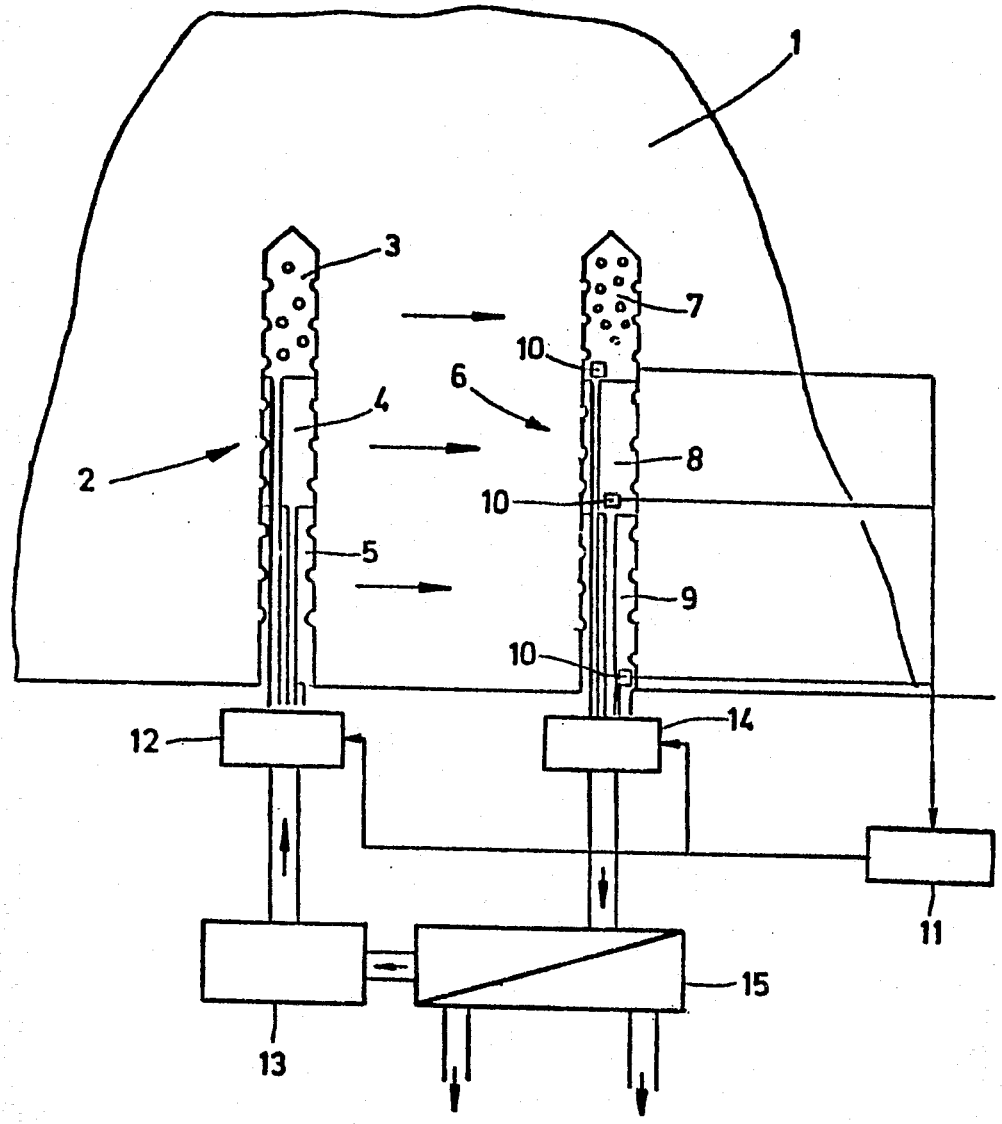
Figure 2:
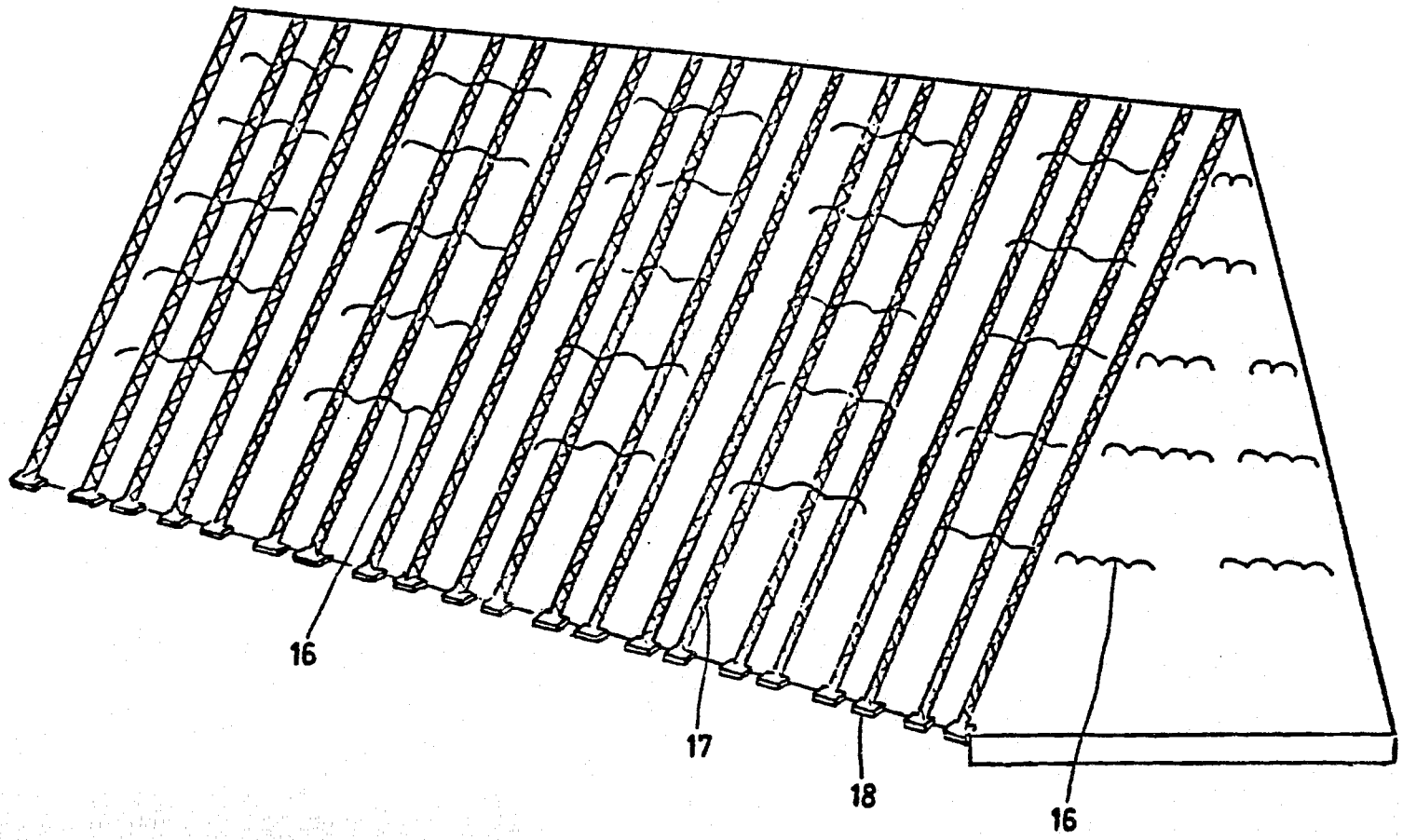

The invention will be explained further in the following with reference to the attached Drawing, in which FIG. 1 shows in the form of a block diagram an arrangement which operates in the way proposed by the invention. FIG. 2 shows schematically a preferred embodiment of a barn for storing organic fibrous material. FIG. 3*a* shows in perspective how, according to the invention, perforated pipes are arranged vertically for blowing air into the stack and for sucking out warmed up and moist air. FIG. 3*b* is a detail from FIG. 3*a*, and shows how the perforated pipes may be fixed in the floor of the barn. FIG. 4 is a cross-section through the barn shown in FIG. 2. FIG. 5 shows an alternative embodiment of an arrangement according to the invention. In the Drawing, parts with the same or similar functions have been given the same reference numerals.

In FIG. 1, 1 is a stack which contains organic fibrous material such as chips, bark and/or so-called organic industrial waste, for example. The stack is assumed to be lying in a well-insulated chamber of the kind which will be described in more detail in connection with FIGS. 2–4. According to the invention, air is blown into the stack at a number of levels depending on the height of the stack, and at each level, at a number of points preferably distributed evenly over the cross-section of the stack. This is accomplished by means of a plurality of pipes 2 which are disposed vertically and are perforated over at least part of their length and are preferably divided up in the longitudinal direction into chambers 3, 4, 5 which are separated from each other. According to the invention, the air is sucked out from the said levels by means of vertically arranged perforated pipes 6 of the same type as the pipes 2, arranged at a distance from the latter. The pipes 6 are also divided up into chambers 7, 8, 9. At each of the said levels the pipes 6 are equipped with a temperature indicator 10 which is connected to a control unit 11. The pipes 2 are connected via a valve element 12 to the pressure side of a fan 13, and the pipes 6 are connected via a valve element 14 and a combined heat-exchanger and demoisturiser 15 to the suction side of the fan 13. The valve elements 12, 14 are connected to and controlled by the control unit 11. Via the control unit 11 which actuates the valve elements 12, 14, the temperature measured at each suction point by means of the temperature indicator 10 controls the blowing in of air so that the temperature of the material in the stack is kept within a predetermined temperature range.

It will readily be appreciated that the biological processes which take place in a stack of organic fibrous material produce a considerable amount of heat energy which can even cause self-ignition. At the start, the fibrous material in the stack has a relatively high water-content which must be reduced so that the combustion level of the fibrous material will be sufficiently high with regard to fuel economy. Due to the heat produced, the water is vapourised and as a result is sucked out of the stack with the air. According to the invention the water and heat content of the sucked-out air is collected, after which the air, thus dried and cooled, is used for blowing into the stack 1. The collected heat may be used for heating purposes of various kinds, such as, for example, for drying timber or for heating areas of a sawmill. According to a special characteristic of the invention, the generation of heat in the stack can be accelerated and intensified by making up the stored fibrous material from a mixture of different types and different size categories of organic fibrous material, for example, birch chips, ground bark and other fibrous waste, together with chips of coniferous trees and forest waste containing needles. By way of example, a preferred mixture comprises coarsely chopped birch chips of grain-size exceeding 30 mm, forest waste of grain-size in the range of 5 to 10 mm, and bark and other fibrous waste of grain-size less than 5 mm.

Figure 3:
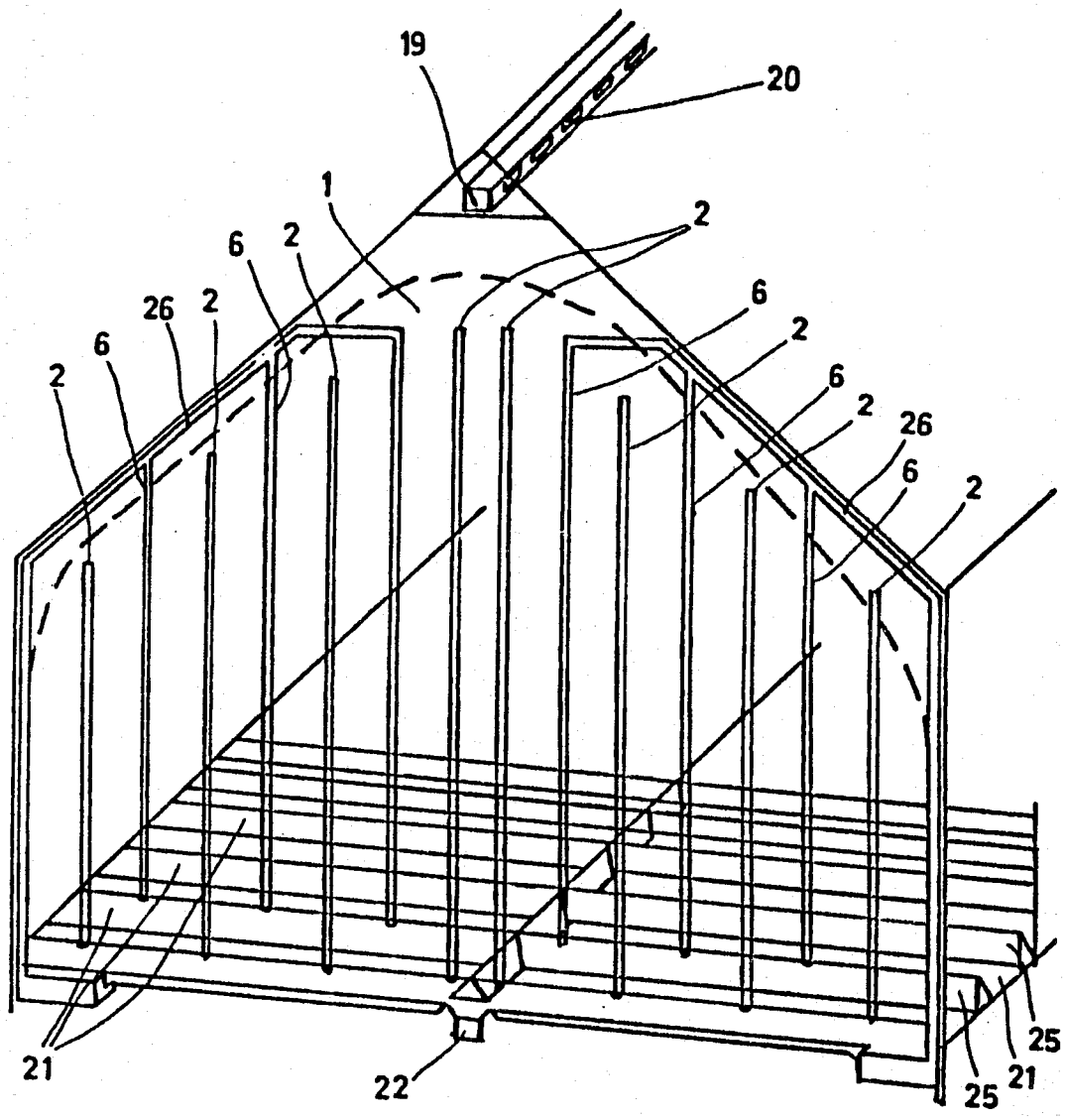
Figure 4:
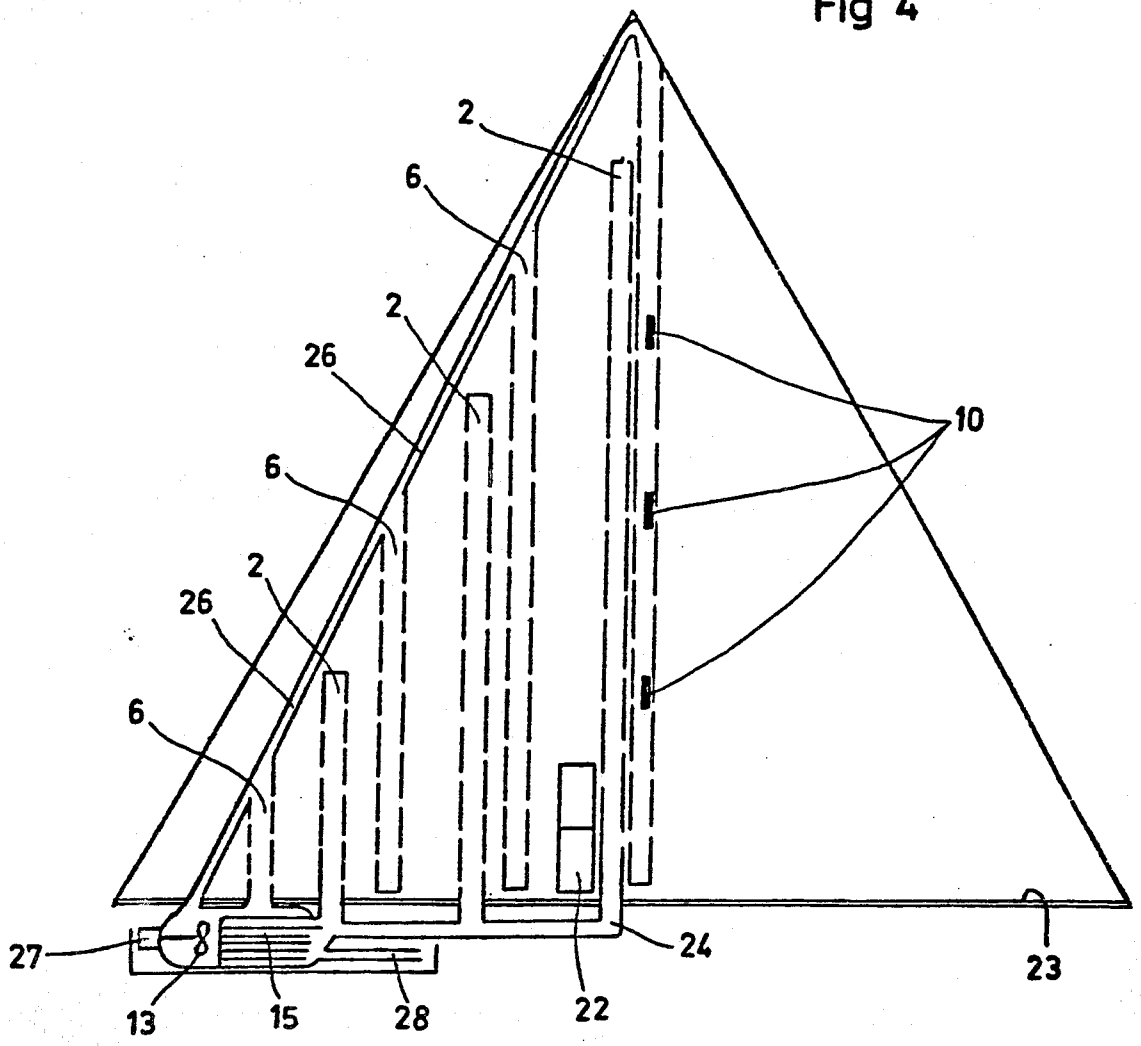
Figure 5:
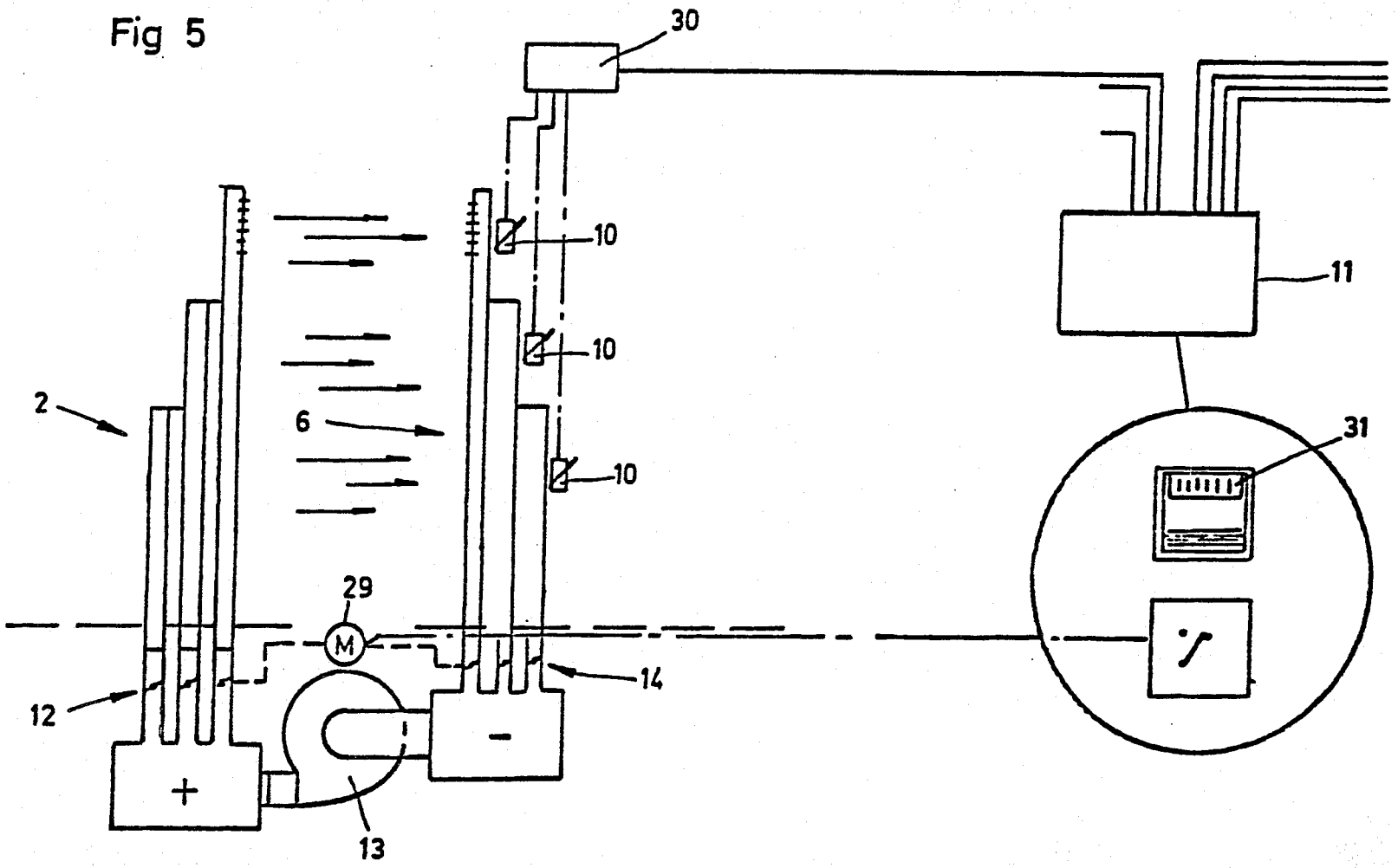

So that the fibrous material may be stored under the best conditions and so that the considerable amount of heat energy which is formed during storage may be made use of, according to the invention storage should be carried out indoors in a barn of the type which is shown schematically in FIGS. 2–4. As can be seen in FIG. 4, the barn is made up of corrugated sheet which at the same time is a roof, the long side 16 being held in place by roof trusses 17 which are supported on base-plates 18. The gable ends are in the shape of a triangle with a base of approximately 30 m and a height of approximately 32 m. The barn is extended expediently in sections according to requirements, but is preferably approximately 100 m. The stack in the barn is fed in from above, for example, by a belt or screw conveyor 19 arranged under the ridge of the barn, in the longitudinal direction thereof; see FIG. 3. The fibrous material is delivered from the conveyor via inlet openings 20 along the conveyor 19. These may be opened and closed so that it is possible to control where along the longitudinal extent of the barn delivery will take place. Removal from the barn is effected by means of conveyors 21 which move from the longitudinal sides of the barn towards a conveyor 22 arranged in the centre of the barn in its floor, or above this, directly under the conveyor 19.

The blowing-in pipes 2 are fixed in the floor 23 of the barn between the conveyors 21 (see FIG. 4) and are supplied via pressure lines 24 laid out in the floor. Plates 25 bent into an angle are provided as protection for the blowing-in pipes 2. The suction pipes 6 are connected to a suction line 26 and are suspended from the roof of the barn. FIG. 4 also shows how the fan 13, driven by an electromotor 27, may be connected to suction lines 26 and to the pressure lines 24 via a heat-exchanger/-demoisturiser 15. The condensed water from the sucked-out air is conducted away via a line 28.

In the alternative embodiment of the invention shown schematically in FIG. 5, the blowing-in and suction pipes 2, 6 are not made of perforated pipe divided up into chambers, which are preferred, but not essential. The said pipes consist of a number of separate pipes of various length, perforated at different levels so that blowing-in and suction can be effected as described earlier. The blowing-in and suction is controlled as before, by the control unit 11 via motors 29 acting on the valve elements 12, 14; only one of these motors is shown in the Figure. The temperature indicator 10 is connected to the control unit 11 via a connection box 30. The control unit 11 is made up of a chart recorder 31 with relay outputs 32. The outputs have a memory function so as to simplify the construction of the control unit.

Obviously, the invention may be varied in many ways within the scope of the concept of the invention.

I claim:

1. In a method of storing moisture bearing organic fibrous materials in a stack within an enclosure, wherein air is circulated through said stack of materials so as to remove a portion of the moisture contained therein, the improvement which comprises steps of:

(1) Injecting dry air into selected levels within said stack via a plurality of air delivery tube means, each of said air delivery tube means (a) being divided into a number of axially separated chambers, and (b) having outlet orifices located at said selected levels;

(2) Withdrawing air from selected levels within said stack via a plurality of suction tube means located adjacent said air delivery tube means, each of said suction tube means (a) being divided into a number of axially separated chambers; and (b) having inlet orifices located at said selected levels;

(3) Measuring the temperature of the air removed from said stack at said selected levels, and controlling the flow of air into said selected levels so as to maintain the temperature of said material at said selected levels in said stack within a predetermined temperature range;

(4) Collecting at least a portion of the air removed from said stack, and treating said air so as to (a) remove moisture and (b) cool said air; and, (5) Returning said dried cool air to said stack via said air delivery tube means.

2. In a method according to claim 1, the improvement wherein said stored fibrous material comprises a mixture of different types and size categories of organic fibrous material.

3. In a method according to claim 2, the improvement wherein said fibrous material comprises birch chips, ground bark and other fibrous waste, chips from pine trees and forest waste containing needles.

4. In a method according to claim 3, the improvement wherein said birch chips comprise grain-size chips of a size exceeding 30 mm, said forest waste is of a size in the range of 5–10 mm, and said bark and other fibrous waste materials are of a size of less than 5 mm.

5. In a method according to any one of claims 1 to 5, and including the steps of adding fresh organic fibrous material to the top of said stack, and removing dried material from the bottom of said stack.

6. Apparatus according to claim 1, wherein said enclosure is substantially airtight and insulated.

7. Apparatus for controlling conditions within the interior of a stack of organic fibrous materials so as to (A) prevent spontaneous combustion of said materials, and (B) remove moisture from said materials, comprising in combination:

(1) An enclosure having a floor and a roof for accommodating said stack;

(2) A plurality of air delivery tube means, each of said air delivery tube means (a) being divided into a number of axially separated chambers, and (b) having a number of outlet orifices over at least part of its length which communicate with respective of said chambers;

(3) A plurality of suction tube means, each of said suction tube means (a) being divided into a number of axially separated chambers, and (b) having a number of inlet orifices over at least a part of its length which communicate with respective of said chambers, said first and second pluralities of tubes being distributed throughout said stack, and separated from one another with their respective inlet and outlet orifices located at selected levels within said stack;

(4) Blower means having a high pressure side and a low pressure side;

(5) Conduit means connecting said plurality of air delivery tube means to said blower high pressure side;

(6) Conduit means connecting said plurality of suction tube means to said blower low pressure side;

(7) Valve means associated with each chamber of said air delivery tube means and said suction tube means, said valve means being operative in response to temperature measurements made at said suction tube inlet orifices;

(8) Temperature sensing means for measuring the temperature at said suction tube inlet orifices;

(9) Control means responsive to said temperature sensing means for controlling said valve means so as to maintain the temperatures at selected levels in said stack within predetermined temperature ranges; and

(10) Heat exchanger/de-moisturizer means located in line between said conduit means connecting said suction tube means and said blower low pressure side for extracting heat and moisture from the air withdrawn from said stack.

8. Apparatus according to claim 7, wherein said air delivery tube means are fixed to the floor of said enclosure, and said suction tube means are suspended from the roof of said enclosure.

* * * * *